US006022159A

United States Patent [19]

Kossnar et al.

[11] Patent Number: 6,022,159

[45] Date of Patent: Feb. 8, 2000

[54] UNIQUE DUAL PEN HOLDER

[75] Inventors: Dennis Kossnar, Elk Grove Village; Cyril Crane, Downers Grove, both of Ill.

[73] Assignee: JAC Investments, Inc., Elk Grove Village, Ill.

[21] Appl. No.: 09/170,740

[22] Filed: Oct. 13, 1998

[51] Int. Cl.[7] ..... B43K 23/08

[52] U.S. Cl. ..... 401/35; 401/131; 401/202; 401/243; 211/69.5

[58] Field of Search ..... 401/131, 35, 18, 401/243, 202; 220/23.4; D19/85, 57; 211/69.9, 69.1, 69.5

[56] References Cited

U.S. PATENT DOCUMENTS

D. 407,439 3/1999 Kossnar et al. ..... D19/85
1,739,363 12/1929 Kraft ..... 220/23.4
4,573,818 3/1986 Kodera ..... 401/131
5,033,629 7/1991 Caine ..... 211/69.5

FOREIGN PATENT DOCUMENTS 2489753 3/1982 France ..... 401/18

*Primary Examiner*—Steven A. Bratlie
*Attorney, Agent, or Firm*—Knechtel, Demeur & Samlan

[57] ABSTRACT

A pen holder uniquely designed for holding two writing utensils in their individual capacity, separated from adjacent writing utensils, while providing protection for the marking tips of the writing utensils. The pen holder consists of a tube casing containing two tubes. Each tube is predisposed for releasably retaining a writing utensil, particularly a pen. Separating the tubes within the tube casing and the writing utensils received within each tube is a dividing wall.

10 Claims, 1 Drawing Sheet

UNIQUE DUAL PEN HOLDER

I. FIELD OF THE INVENTION

The present invention relates to the design and construction of writing utensil holders and, more particularly, to a pen holder that is uniquely designed to serve the dual purpose of holding two adjacent pens, secured independently from one other, while protecting the marking tips of the two pens.

II. DESCRIPTION OF THE PRIOR ART

Writing utensils have been around for a long time. In all that time there remains one constant: writing utensils require protection for the marking tips. Typically, pen holders have provided this protection.

In the past, various types of pen holders have been used. Many pen holders are found on office desks and tables. The desk pen holders typically consist of a base in a rectangular or circular shape. Attached to the top of the base is a receptacle which is closed at the bottom where it is attached to the base and open at the top to receive the pen. The angle of the receptacle in reference from the horizontal with the base is usually variable. A shortcoming of these desk pen holders is that, due to their weight and bulky nature, the pen holder and its respective writing utensil cannot be transported with the owner for spontaneous later use; but instead, must remain with the office desks and/or tables. Additionally, if these desk pen holders are moved from one place to another, the pens held by the receptacle are not very secure and, therefore, susceptible to falling out. Another shortcoming is that the desk pen holders are not designed to hold multiple pens in a compact fashion.

Subsequently, many devices have been designed for carrying writing utensils. The devices consist primarily of cases with an opening at the top and closed at the bottom. The writing utensil is placed in its entirety within the case. Some cases are designed to hold multiple writing utensils side-by-side within the same case. Occasionally, the opening in the top of the case is covered by a lid or flap to secure the writing utensils inside the case. These carrying cases are usually very light and approximately the same length as the writing utensils for easy placement in ones shirt or pants pocket. An inherent problem with the carrying case is that the writing utensils are not individually secured within the carrying case. As a result, upon the removal of any one writing utensil, the others are easily susceptible to falling out. Another problem with carrying cases is that the carrying case is an item separate and distinct from the writing utensils and, therefore, the carrying case only functions to transport multiple writing utensils in an organized manner in lieu of loosely carrying multiple writing utensils. Additionally, the carrying case does not protect the marking tips of the writing utensils.

Another writing utensil has been devised to house within the utensil's chamber multiple ink cartridges. This typically serves to permit a user the opportunity to write in several colors such as blue, red, green, etc. using only a single writing utensil. A shortcoming of this writing utensil is that it does not provide a holder for securing a second writing utensil, in its individual capacity, separate from itself.

There is a need, therefore, and there has never been disclosed a pen holder that is uniquely designed to serve the dual purpose of holding multiple pens distinctly separate from the other while protecting the marking tips of both pens.

III. OBJECTS OF THE INVENTION

It is the primary object of the present invention to provide a unique pen holder for holding multiple writing utensils in their individual capacity, separated from adjacent writing utensils. A related object of the present invention is to permit complete removal of a writing utensil without interfering with the security or protection of adjacent writing utensils. Still another related object of the present invention is to provide a pen holder that protects the marking tips of the writing utensils.

Another object of the invention is to provide a carrying case for easy transportation of multiple writing utensils. A related object of the invention is to provide a carrying case that is small enough for easy placement in a shirt or pants pocket.

Other objects of the present invention will become more apparent to persons having ordinary skill in the art to which the present invention pertains from the following description taken in conjunction with the accompanying drawings.

IV. SUMMARY OF THE INVENTION

The present invention is a pen holder designed to hold two pens in their individual capacity, independent from the other, while simultaneously protecting the marking tips of both pens. The pen holder consists of three main parts: a casing, at least two tubes, and a dividing wall.

The casing has two parallel circular tubes. Each tube is designed for receiving a writing utensil, particularly a pen. The top portion of a pen is inserted into each tube. Following the insertion of the top portion of each pen into the tubes, the remaining portion of the pens not received within the tube extends outwardly from the casing, separated by a small distance. The small distance separating the pens is filled by a dividing wall acting in conjunction with the casing to secure the pens.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
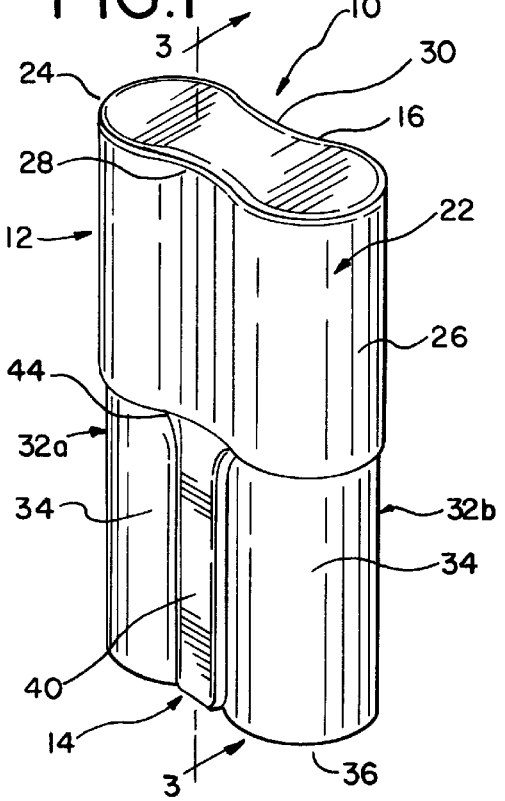
FIG. 1 is a perspective view of applicant's invention showing the pens secured within the pen holder.
Figure 2:
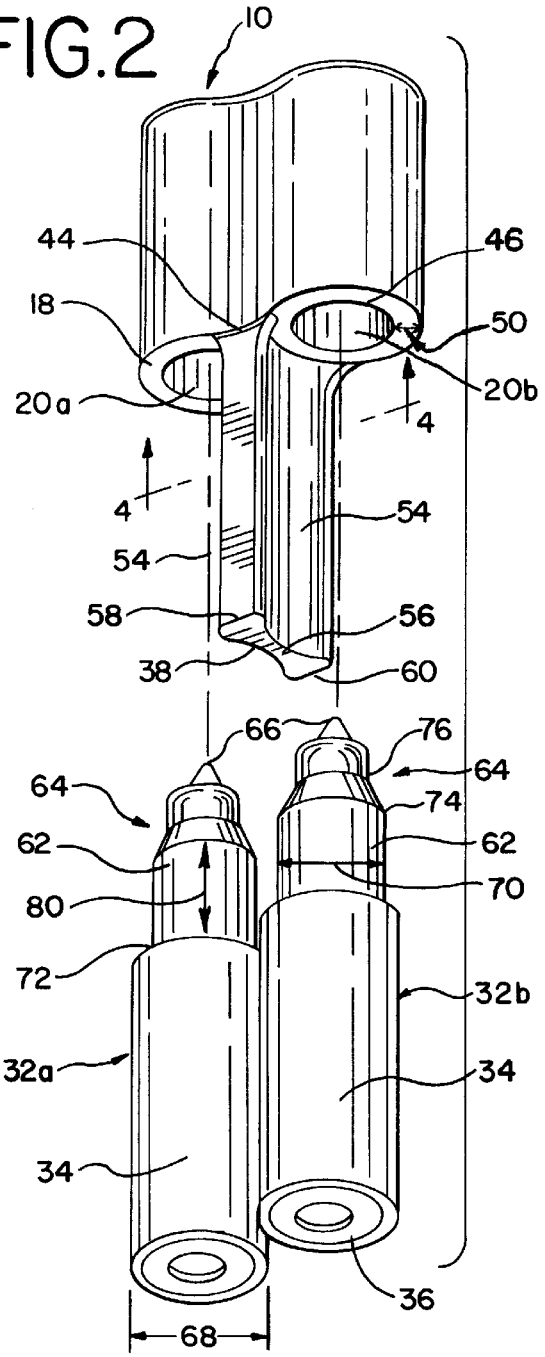
FIG. 2 is an exploded view of FIG. 1 with the pens detached in their individual capacity from the pen holder.

Turning first to FIG. 1, there is illustrated a pen holder 10. The pen holder 10 is preferably made of a durable plastic, but strong enough to withstand constant use without cracking or breaking. The pen holder 10 consists of a tube casing 12 and a dividing wall 14. The tube casing 12 has a casing top 16 and a casing bottom 18 (FIG. 2). The surface of both the casing top 16 and the casing bottom 18 are flat. The tube casing 12 is open at the casing bottom 18 with two cylindrical bores forming tubes 20*a* and 20*b* (FIG. 2). The tube casing 12 has a smooth casing exterior 22. At exterior ends 24 and 26, the casing exterior 22 is cylindrical in shape. As the cylindrical shape, from exterior ends 24 and 26, approaches the center of the tube casing 12, a concave arc is formed at exterior center points 28 and 30. Preferably, the entire casing exterior 22, between casing top 16 and casing bottom 18, follows the same shape and contour. Tubes 20*a* and 20*b* (FIG. 2) are designed to receive and hold pens 32*a* and 32*b*. The pens 32*a* and 32*b* are a conventional form of writing utensil. The writing utensil is preferably made of the same durable plastic as the pen holder 10. The pens 32*a* and 32*b* have a base 34 that is hollow to store marking ink inside. The marking ink may be any color including but not limited to black, blue, red, green, or yellow. Additionally, the marking ink may be of the type used as a highlighter or as a novelty marking ink to combine with other marking inks to render one of the inks a second color when the other ink is applied to it.

Figure 4:
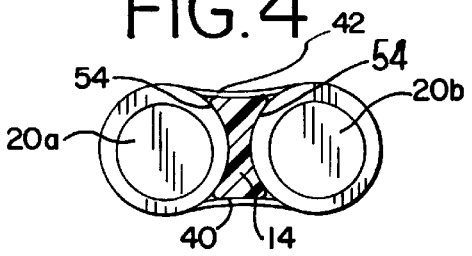
FIG. 4 is a bottom cross sectional view, taken along line 4—4 of FIG. 2.

The base 34 is cylindrical in shape and has a base bottom 36 that is flat. Separating pen 32*a* from pen 32*b* is the dividing wall 14. The dividing wall 14 is preferably made of the same material as the tube casing 12 and pens 32*a* and 32*b*. The dividing wall 14 is attached to the tube casing 12 at a point of attachment 44. Preferably, the dividing wall 14 should be integrally molded to the tube casing 12. The dividing wall 14 is rectangular in shape with a dividing wall bottom 38 (FIG. 2) and two exposed sides 40 and 42 (FIG. 4). The dividing wall bottom 38 is flat and preferably flush with the base bottom 36 of the base 34.

Turning to FIG. 2, the pen holder 10 is shown in its individual form and, more particularly, tubes 20*a* and 20*b* are illustrated. Tubes 20*a* and 20*b* have circular openings of the same inner tube diameter 46 and outer tube diameter 48. The tubes 20*a* and 20*b* are essentially mirror images of each other having the same tube thickness 50. The tube casing bottom 18 also defines the bottom of the tubes 20*a* and 20*b*. Separating the entrance to tubes 20*a* and 20*b* is the dividing wall 14. The dividing wall 14 has a concave curvature 54 on each side of the dividing wall 14 facing the pens 32*a* and 32*b*. In both instances, the concave curvature 54 is an arc approximating the circular shape of the pens 32*a* and 32*b*. As a result, the dividing wall 14 has a midpoint 56 and endpoints 58 and 60. The midpoint 56 has a smaller thickness than the endpoints 58 and 60, which are approximately of the same thickness.

Also, illustrated in its individual form in FIG. 2 are pens 32*a* and 32*b*. Extending from the top of the base 34 is a finger projection 62. Extending from the top of the finger projection 62 is a tapering extension 64. Extending from the tapering extension 64 is a pen tip 66. The tapering of the pens 32*a* and 32*b* permits the insertion of the pens 32*a* and 32*b* into the pen holder 10 and provides a more ergonomic writing pen for the user.

The base 34 has an outer base diameter 68. The finger projection 62 has an outer finger diameter 70 which is less than the outer base diameter 68 of the base 34. The difference between the outer base diameter 68 and the outer finger diameter 70 results in a shoulder 72 on top of the base 34. The finger projection 62 extends a length 80 above the base 34. The tapering extension 64 begins at the top of the finger projection 62 at point 74 and tapers to point 76. From point 76, the tapering extension 64 maintains a constant diameter for a small distance culminating at the pen tip 66.

The pens 32*a* and 32*b* are inserted into tubes 20*a* and 20*b*, respectively. The finger projection 62, tapering extension 64, and pen tip 66 are the only portions of the pens 32*a* and 32*b* that are received into the tubes 20*a* and 20*b*. The inner tube diameter of tubes 20*a* and 20*b* is slightly larger than the outer finger diameter 70 to frictionally engage the projections 62 and, thereby, enable pens 32*a* and 32*b* to be releasably retained within the pen holder 10. Following the insertion of the pens 32*a* and 32*b* within the tubes 20*a* and 20*b*, the shoulder 72 of the base 34 engages the casing bottom 18 of the pen holder 10 to prohibit the pens 32*a* and 32*b* from entering any further into tubes 20*a* and 20*b*. The length of the dividing wall 14, between the point of attachment 44 and the dividing wall bottom 38, is approximately the same length as the base 34, between the shoulder 72 and the base bottom 36, of the pens 32*a* and 32*b*.

The base 34 of the pens 32*a* and 32*b* have an outer base diameter 68 that is approximately the same diameter as the outer tube diameter 48. As the outer base diameter 68 and the outer tube diameter 48 are approximately the same, the exterior of the pens 32*a* and 32*b* are flush with the outside of the tube casing 12 when inserted into tubes 20*a* and 20*b*. As an assembled unit, the pen holder 10 provides a smooth integrated holder for safe, easy use.

Figure 3:
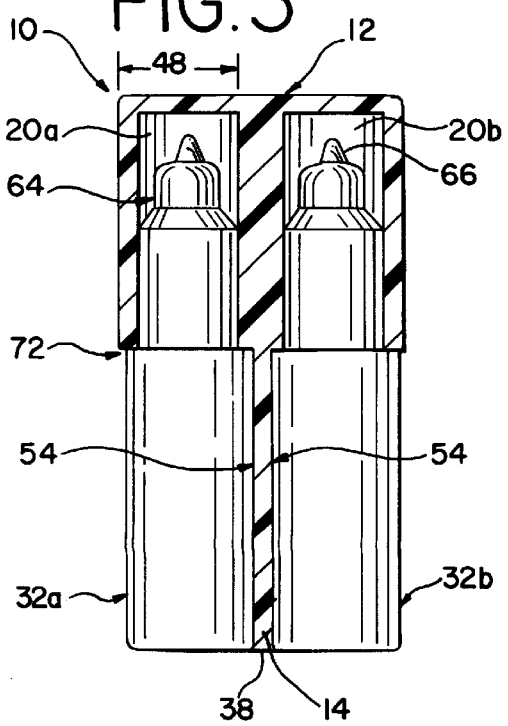
FIG. 3 is a partial cross sectional view, taken along line 3—3 of FIG. 1, showing a cross section of the pen holder and, in particular, shows the pens inserted within the casing and separated by the dividing wall.

Turning to FIG. 3, the placement of the pens 32*a* and 32*b* within the tubes 20*a* and 20*b* is illustrated. The tapering extension 64 and the pen tip 66 remain free and untouched by the interior of the tubes 20*a* and 20*b*. The tube casing 12 and the tubes 20*a* and 20*b* provide a protective cover for the pen tip 66. As a protective cover, the pen tip 66 is prevented from being damaged, drying out due to constant exposure to the elements, and inadvertently marking any object not desired by the user.

The function of the dividing wall 14 is also more clearly illustrated. The main purpose of the dividing wall 14 is to isolate pen 32*a* from pen 32*b* and, thereby, permit each pen to be secured individually within the pen holder 10. The dividing wall 14 also serves to aid in the holding of the pens 32*a* and 32*b* within the pen holder 10. The base 34 of pens 32*a* and 32*b* is form fitted into the concave curvature 54 (FIG. 2) of the dividing wall 14. Upon the insertion of the pens 32*a* and 32*b* into the tubes 20*a* and 20*b* of the pen holder 10, the tubes 20*a* and 20*b* and the concave curvature 54 of the dividing wall 14 unite to stabilize the pens 32*a* and 32*b* within the pen holder 10. As a result, the pens 32*a* and 32*b* are prevented from easy or undesired movement within the pen holder 10.

Thus, there has been provided a pen holder designed to releasably retain multiple pens independently, but integrally secured within an assembled unit providing protection for the marking tips of the pens. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A housing for holding multiple writing utensils comprising:

a molded structure, the structure having an open end and a closed end, the open end having multiple chambers;

a writing utensil received in each chamber within the molded structure, the writing utensil having a top portion and a base, the top portion of each writing utensil being received in each chamber, the base extending outwardly from the open end of the molded structure, the base having a circular shape; and a dividing wall attached to the open end of the structure and separating each writing utensil, the dividing wall having two opposite surfaces, one surface engaging the base of one writing utensil and the other opposite surface engaging the surface of the other writing utensil, the surfaces having a concave curvature that approximates the circular shape of each base, the dividing wall stabilizing each writing utensil within the housing.

2. The housing for holding multiple writing utensils of claim 1 wherein each writing utensil is a pen or highlighter.

3. A multiple pen holder comprising:

a housing, the housing having an open end and a closed end, the open end having a first opening and a second opening, the first and second openings having substantially identical inner diameters defining inner walls;

a first and second writing utensil received into the first opening and the second opening respectively, the first and second writing utensil releasably retained by frictional engagement with the inner walls of the first opening and the second opening;

a dividing wall attached to the open end of the housing and separating the first writing utensil and the second writing utensil, whereby the dividing wall and the housing combine to stabilize the first and second writing utensil.

4. The multiple pen holder of claim 3 wherein the writing utensil is a pen or highlighter.

5. The multiple pen holder of claim 3 wherein the first opening and second opening are cylindrical bores within the housing.

6. The multiple pen holder of claim 3 wherein the dividing wall is integrally molded to the housing.

7. A multiple pen holder comprising:

a tube casing, the tube casing having a first tube and a second tube, the first and second tubes having inner walls which are cylindrical in shape and have an open end and a closed end;

a first writing utensil inserted into the open end of the first tube, the first writing utensil cylindrical in shape and having a first portion and a second portion of the first writing utensil, the first portion releasably retained within the first tube by frictional engagement with the inner walls of the first tube, the second portion having a shoulder to permit only the first portion to enter the first tube, the second portion remaining exposed and extending outwardly from the tube casing;

a second writing utensil inserted into the open end of the second tube, the second writing utensil cylindrical in shape and having a first portion and a second portion of the second writing utensil, the first portion releasably retained within the second tube by frictional engagement with the inner walls of the second tube, the second portion having a shoulder to permit only the first portion to enter the second tube, the second portion remaining exposed and extending outwardly from the tube casing; and a dividing wall attached to the open end of the tube casing separating the second portion of both the first writing utensil and the second writing utensil, the dividing wall having concave curved sides partially encompassing the second portion of both the first writing utensil and the second writing utensil to secure and stabilize the second portion of the first writing utensil and the second writing utensil, the second portion of both the first writing utensil and the second writing utensil not encompassed by either the dividing wall or the tube casing remaining exposed.

8. The multiple pen holder of claim 7 wherein the writing utensil is a pen or highlighter.

9. The multiple pen holder of claim 7 wherein the first portion and the second portion of the first writing utensil is identical to the first portion and the second portion of the second writing utensil.

10. The multiple pen holder of claim 8 wherein the dividing wall is integrally molded to the tube casing.

* * * * *